US006685494B1

(12) United States Patent
McHugh et al.

(10) Patent No.: US 6,685,494 B1
(45) Date of Patent: Feb. 3, 2004

(54) ELECTRICAL CONNECTOR WITH STIFFENER

(75) Inventors: Robert G. McHugh, Golden, CO (US); Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/442,553

(22) Filed: May 20, 2003

(51) Int. Cl.[7] ..... H01R 13/625
(52) U.S. Cl. ..... 439/342; 439/331
(58) Field of Search ..... 439/342, 259, 439/331, 261, 266

(56) References Cited

U.S. PATENT DOCUMENTS 4,504,105 A 3/1985 Barkus et al.
5,057,031 A * 10/1991 Sinclair ..... 439/261
5,616,044 A * 4/1997 Tsai ..... 439/342
6,086,402 A * 7/2000 Huang ..... 439/342
6,264,489 B1 * 7/2001 McHugh et al. ..... 439/342

* cited by examiner

*Primary Examiner*—Tho D. Ta
(74) *Attorney, Agent, or Firm*—Wei Te Chung

(57) ABSTRACT

An LGA connector (1) includes a housing (2), a multiplicity of terminals (6) received in the housing, a stiffener (3) mounted on the housing, a load plate (4) pivotally mounted to a second end portion (23) of the housing, and a load lever (5) attached to a first end portion (22) of the housing. The housing comprises two opposite sidewalls (24) each including two latch portions (240), two channels (244) in a bottom thereof at respective latch portions thereby forming two resilient arms (246). The stiffener includes two elongated first plates (32) having two latch slots (320) for engaging with the corresponding latch portions of the housing. Thus, flexibility of the latch portions of the housing is enhanced thereby facilitating easy attachment of the stiffener onto the housing.

8 Claims, 6 Drawing Sheets

ELECTRICAL CONNECTOR WITH STIFFENER

CROSS-REFERENCE TO RELATED APPLICATION

This present application is related to a U.S. patent application Ser. No. 10/418,434 filed on Apr. 17, 2003, entitled "LAND GRID ARRAY CONNECTOR ASSEMBLY WITH REINFORCEMENT," invented by the same inventor as that of the present application, and assigned to the same assignee as that of the present application.

BACKGROUND OF THE INVENTION

1. Field of the Invention

The present invention relates to an electrical connector for electrically connecting an electronic package such as a land grid array (LGA) chip with a circuit board such as a printed circuit board (PCB), and particularly to an LGA electrical connector with a stiffener and a housing.

2. Description of Prior Art

Land grid array (LGA) electrical connectors are widely used in personal computer (PC) systems to electrically connect land grid array (LGA) chips with printed circuit boards (PCBs). An LGA electrical connector comprises an insulative housing, a multiplicity of terminals received in the housing in a rectangular array, a metal load plate pivotally mounted to the housing, and a load lever attached to the housing. This kind of LGA electrical connector is disclosed in U.S. Pat. No. 4,504,105. In use, the load plate exerts great force on the housing. However, the housing is made from insulative material, and is prone to deformation and damage.

The co-pending U.S. patent application Ser. No. 10/418434 shows another kind of LGA electrical connector. Referring to FIGS. 5 and 6, the LGA electrical connector 7 comprises an insulative rectangular housing 71, a multiplicity of conductive terminals 75 received in the housing 71, a stiffener 72 mounted on the housing 71, a metal load plate 74 mounted to the housing 71, and a load lever 73 attached to the housing 71. The load plate 74 comprises a pair of curved pivot latches 742 extending from a rear end thereof, and a hook portion 741 extending from an opposite front end thereof. The load lever 73 comprises a handle 734, an operational arm 733 extending perpendicularly from one end of the handle 734, a pair of pivot axles 731 extending perpendicularly from a distal end of the operational arm 733, and an offset pressing portion 732 between the two pivot axles 731. The stiffener 72 stamped from a sheet of metallic material and comprises a planar portion 721 defining an opening 722 in a middle thereof, and two opposite elongated plates 723 depending from outer side edges of the planar portion 721. A pair of spaced latch slots 724 is defined on each elongated plate 123. A pair of locating latches 725 extends downwardly from inner side edges of the planar portion 721.

The housing 71 comprises a rectangular main body 711 in a middle thereof, and two opposite sidewalls 712. The main body 711 defines a plurality of passageways 718 for receiving the corresponding terminals 75. The housing 71 defines a pair of spaced pivot holes 713 in a rear end thereof for engaging with the pivot latches 742 of the load plate 74 to pivotally mount the load plate 74 to the housing 71. The housing 71 defines a generally trapezoidal receiving recess 714 and an elongated receiving groove 715, in an opposite front end thereof. A pair of latch portions 716 protrudes outwardly from each sidewall 712, corresponding to the latch slots 724 of the stiffener 72. A pair of locating holes 717 is defined on inner sides of the opposite sidewalls 712, corresponding to the locating latches 725 of the stiffener 72.

Referring to FIG. 7, in assembly, the latch slots 724 of the stiffener 72 engage respectively with the latch portions 716 of the housing 71, and the locating latches 725 of the stiffener 72 respectively plug into the locating holes 717 of the housing 71. Thus, the stiffener 72 is mounted on the housing 71. The pivot latches 742 of the load plate 74 are received in the corresponding pivot holes 713 of the housing 71, and accordingly the load plate 74 is pivotally mounted to the housing 71. The pivot axles 731 of the lever 13 are received in the groove 715, and the pressing portion 732 is movably retained in the T-shaped recess 714.

However, the latch portions 716 of the housing 71 are made from insulative material, which has limited flexibility. In addition, there are no complementary structures to enhance what flexibility there is of the latch portions 716. Accordingly, assembly of the stiffener 72 to the housing 71 is unduly difficult. In addition, because the stiffener 72 is made of metallic material, it has high strength compared with the housing 71. Thus, in assembly, the housing 71 is liable to distort and be damaged.

A new electrical connector that overcomes the above-mentioned problems is desired.

SUMMARY OF THE INVENTION

An object of the present invention is to provide an electrical connector having a housing with resilient arms that facilitate ready engagement of a stiffener onto the housing.

In order to achieve the above object, an electrical connector in accordance with a preferred embodiment of the present invention comprises an insulative housing, a plurality of terminals received in the housing, a stiffener mounted on the housing, a metal load plate, and a load lever. The housing comprises two opposite sidewalls, a first end portion and a second end portion. The load plate is pivotally attached to the second end portion of the housing, and the load lever is mounted to the first end portion of the housing. Each of the sidewalls comprises a pair of spaced latch portions, and defines a pair of channels in a bottom thereof at respective latch portions thereby forming two resilient arms. The stiffener comprises two elongated first plates having two latch slots for engaging with the corresponding latch portions of the housing. Thus, flexibility of the latch portions of the housing is enhanced thereby facilitating easy attachment of the stiffener onto the housing.

Other objects, advantages and novel features of the present invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
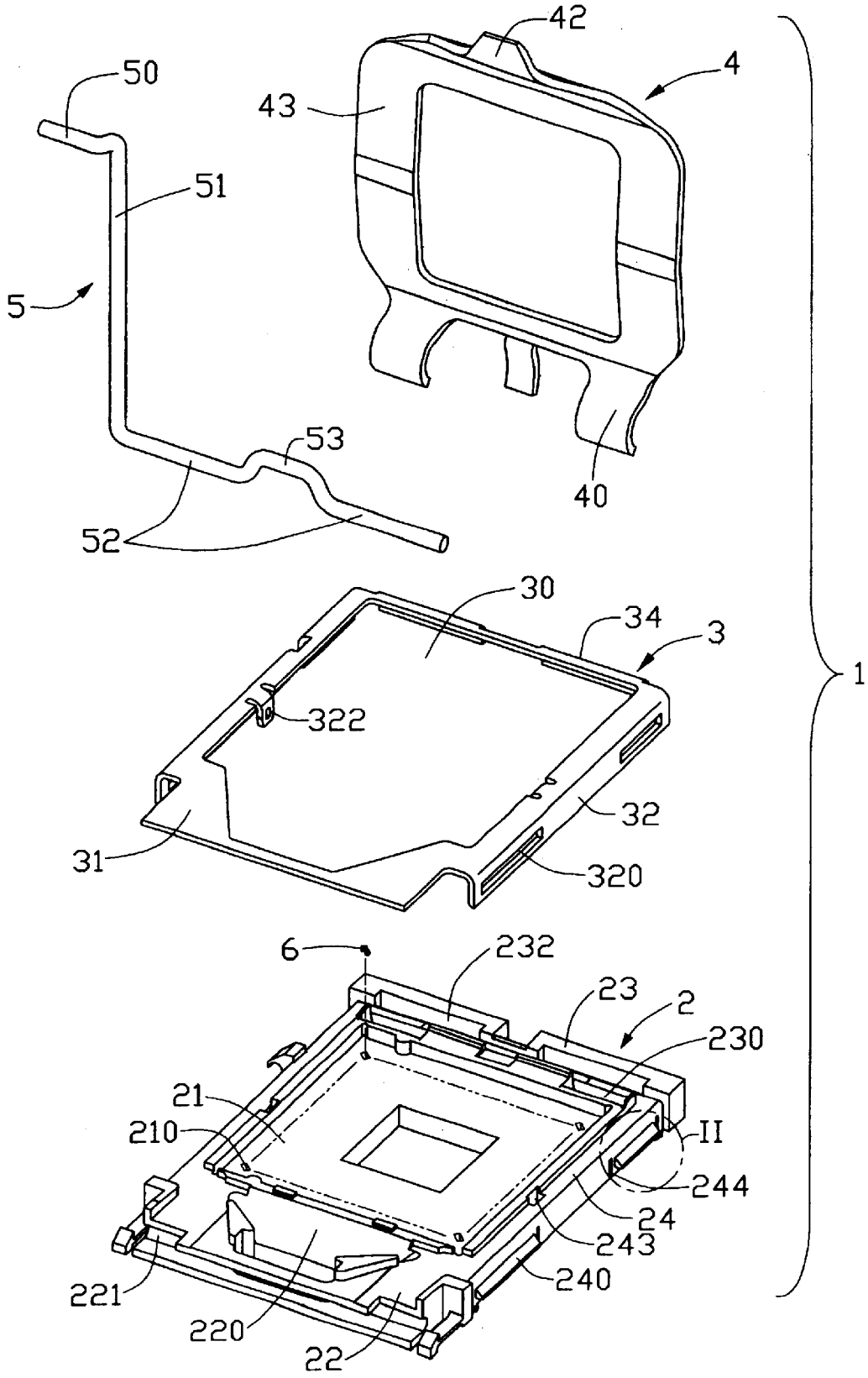
FIG. 1 is a simplified, exploded isometric view of an electrical connector in accordance with the preferred embodiment of the present invention.

Referring to FIG. 1, an LGA electrical connector 1 in accordance with the preferred embodiment of the present invention is adapted for electrically connecting an electronic package such as a land grid array (LGA) chip (not shown) with a circuit substrate such as a printed circuit board (PCB) (not shown). The electrical connector 1 comprises an insulative rectangular housing 2, a multiplicity of conductive terminals 6 received in the housing 2, a stiffener 3 mounted on the housing 2, a load plate 4 pivotally mounted to the housing 2, and a load lever 5 engaged with the housing 2.

Figure 2:
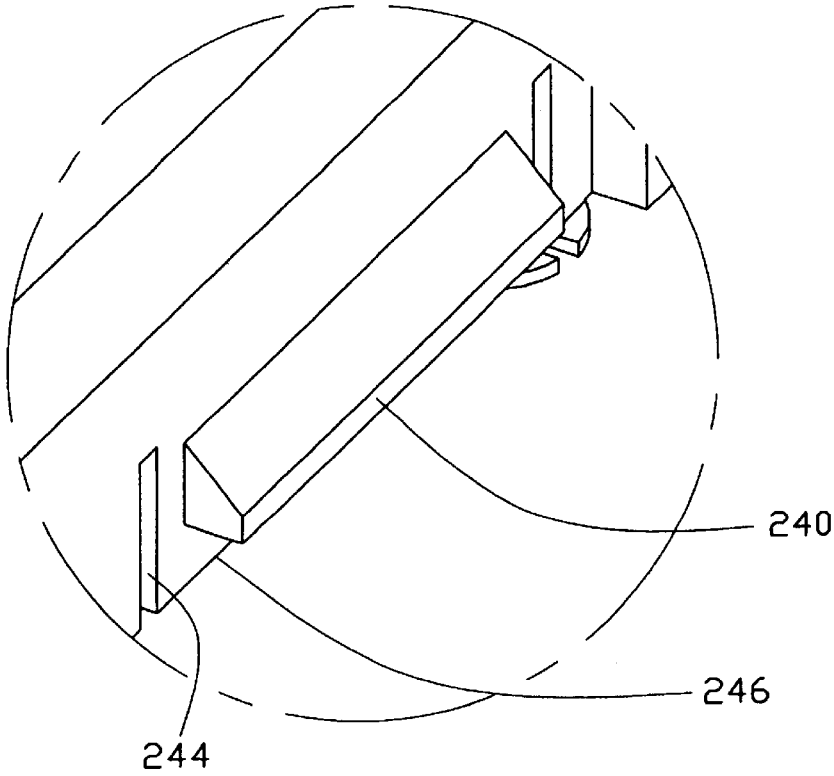
FIG. 2 is an enlarged view of a circle portion II of FIG. 1.
Figure 3:
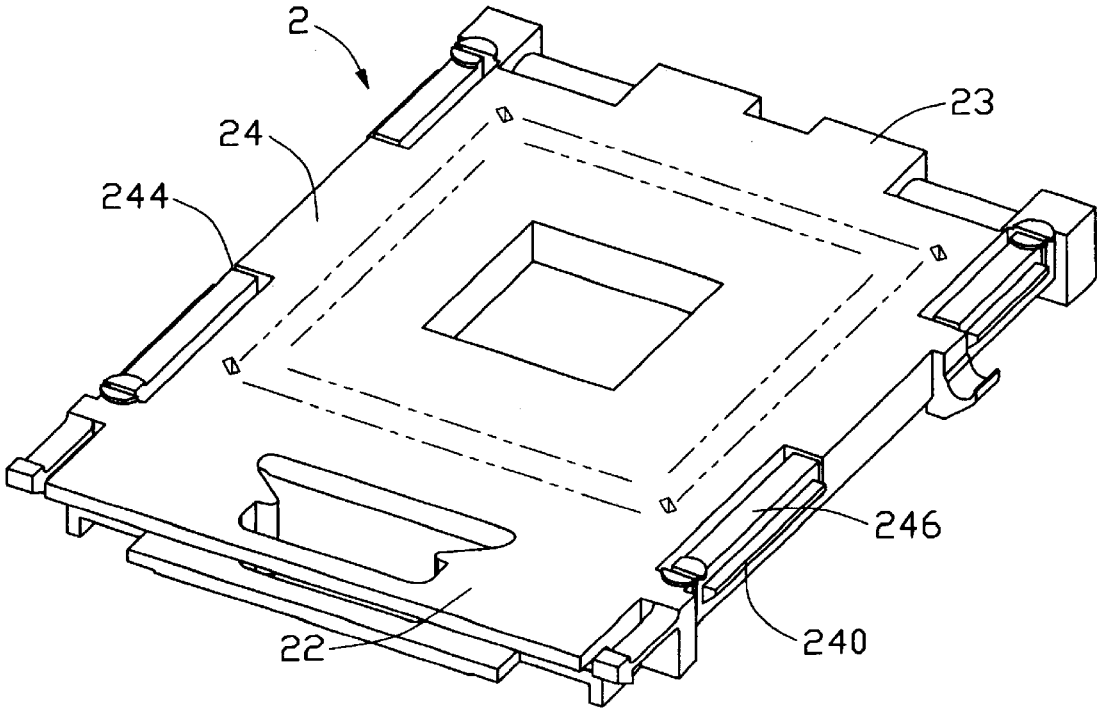
FIG. 3 is an enlarged, inverted view of a housing of the electrical connector of FIG. 1.

Referring also to FIGS. 2 and 3, The housing 2 defines a rectangular space 21 in a center thereof, for receiving the LGA chip. A main portion (not labeled) of the housing 2 below the space 21 defines a plurality of passageways 210 arranged in a rectangular array, the passageways 210 receiving the corresponding terminals 6. The space 21 is bounded by a first end portion 22, a second end portion 23 opposite to the first end portion 22, and a pair of opposite sidewalls 24 interconnecting the first and second end portions 22, 23. The first end portion 22 defines a longitudinal elongated receiving groove 221 in a front thereof, and a generally trapezoidal receiving recess 220 adjacent the space 21 and in communication with the receiving groove 221. The second end portion 23 defines a pair of spaced, aligned pivot slots 230 adjacent the space 21, and a pair of aligned locating recesses 232 rearwardly of the pivot slots 230. Each sidewall 24 comprises a pair of spaced, aligned latch portions 240 protruding outwardly from an outside face thereof, and defines a locating slot 243 adjacent the space 21. A pair of spaced C-shaped or U-shaped channels 244 is defined in a bottom of each sidewall 24 at respective latch portions 240, thereby forming a pair of resilient arms 246. Thus, flexibility of the latch portions 240 is enhanced.

The stiffener 3 is stamped from a sheet of metallic material and formed as a generally rectangular frame. The stiffener 3 comprises a planar portion 31 defining an opening 30 in a middle thereof, two elongated first plates 32 depending from opposite outer sides of the planar portion 31 respectively, and a pair of spaced second plates 34 depending from a rear end of the planar portion 31 and corresponding to the locating recesses 232 of the housing 2. Each first plate 32 defines a pair of latch slots 320, corresponding to respective latch portions 240 of the housing 2. A pair of locating latches 322 depends downwardly from opposite inner sides of the planar portion 31 respectively, corresponding to the locating slots 243 of housing 2.

The load plate 4 comprises a main body 43 defining an opening (not labeled) in a middle thereof. A pair of spaced, curved pivot latches 40 depends from a rear end of the main body 43, corresponding to the pivot slots 230 of the housing 2. A hook portion 42 extends from an opposite front end of the main body 43.

The load lever 5 comprises a handle 50, an operational arm 51 extending perpendicularly from one end of the handle 50, and a pair of pivot axles 52 extending perpendicularly from a distal end of the operational arm 52 with an offset pressing portion 53 between the two pivot axles 52.

Figure 4:
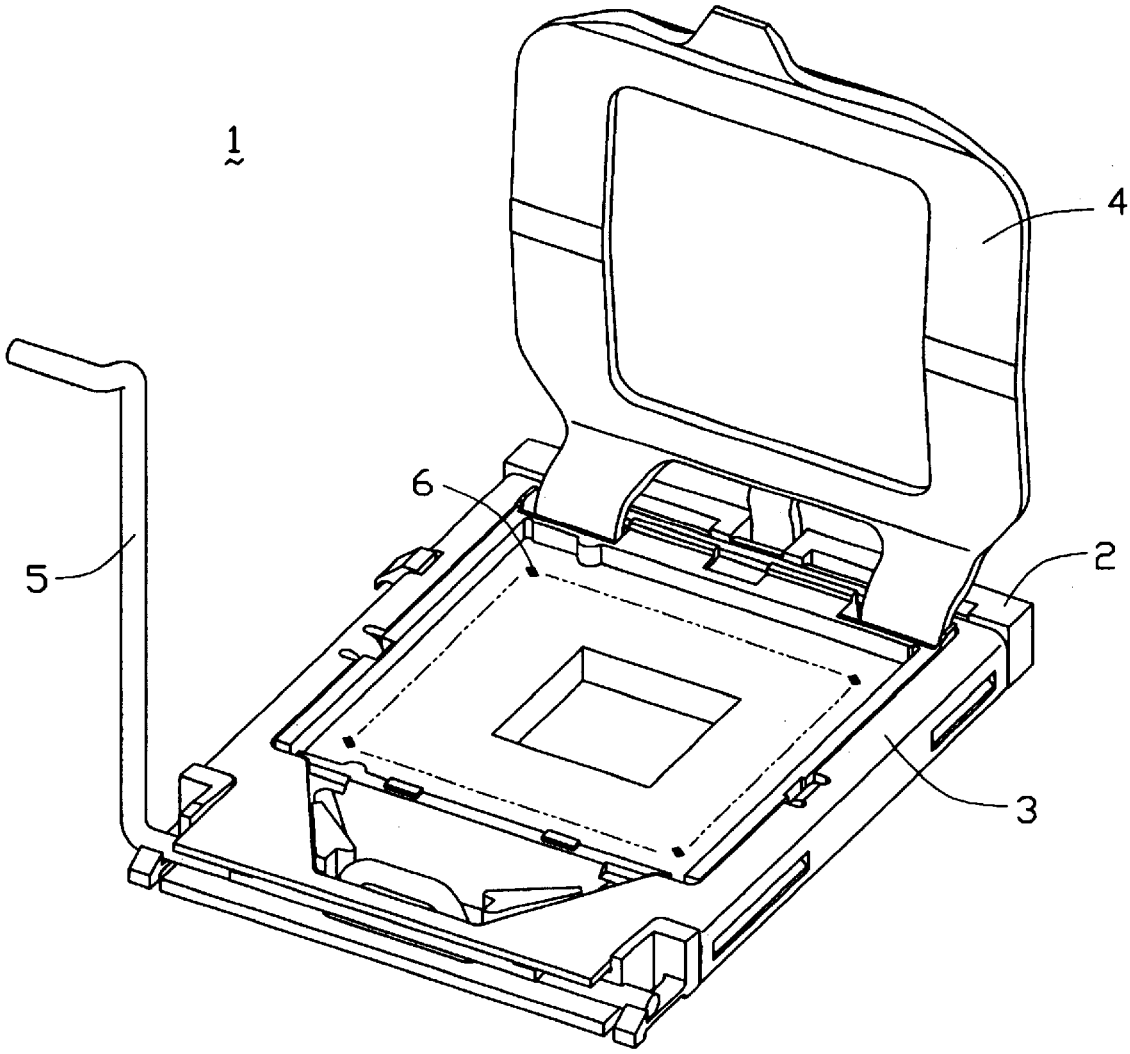
FIG. 4 is an isometric assembled view of FIG. 1.
Figure 5:
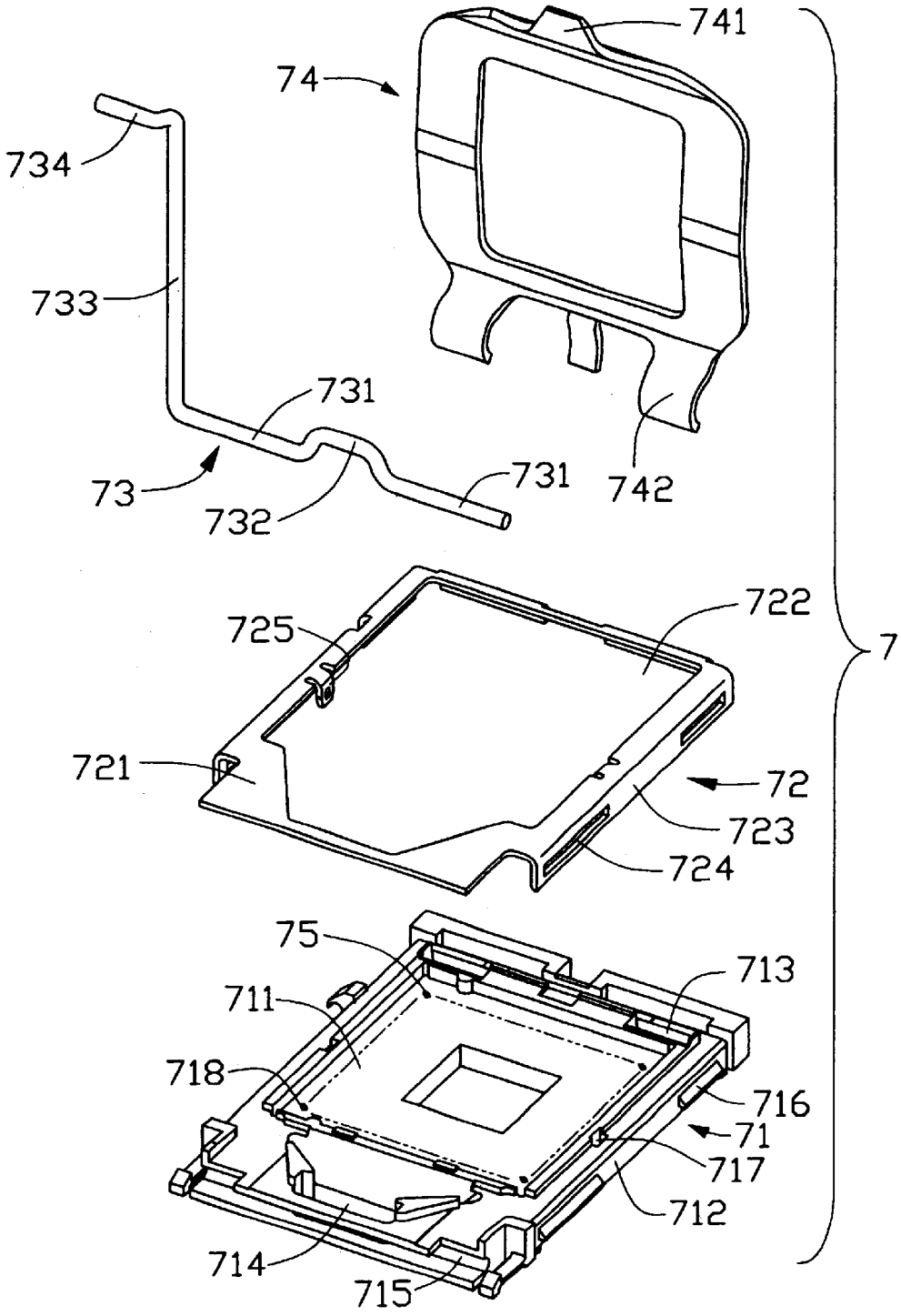
FIG. 5 (PRIOR ART)
FIG. 5 is a simplified exploded, isometric view of a conventional electrical connector.
Figure 6:
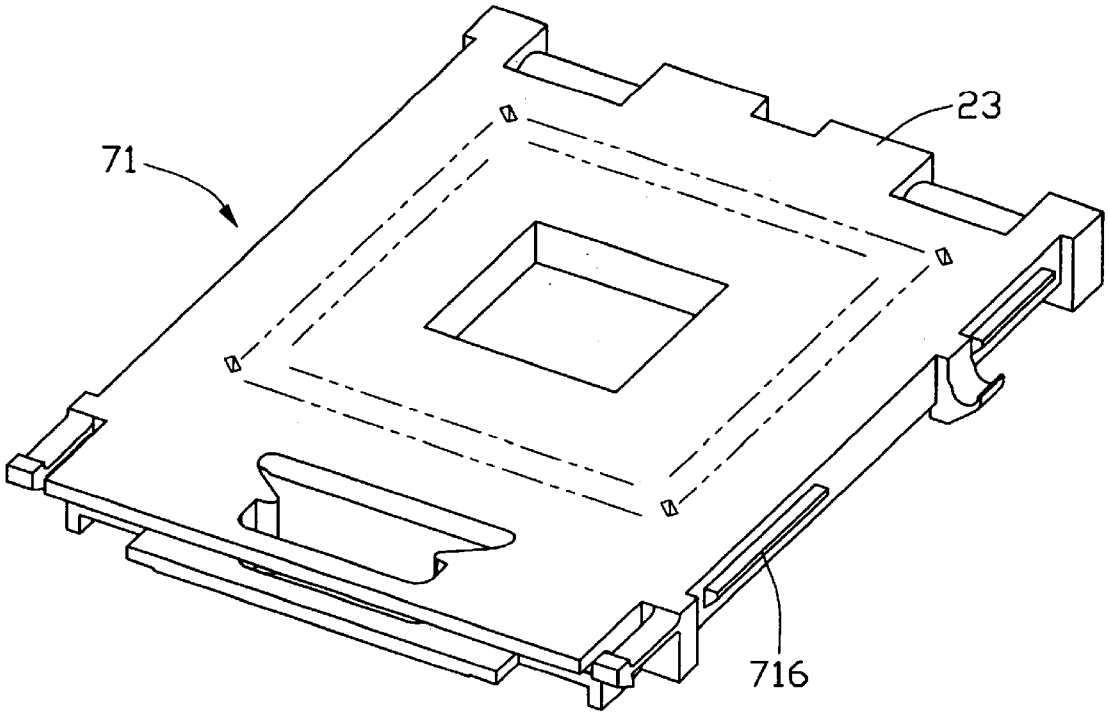
FIG. 6 (PRIOR ART)
FIG. 6 is an enlarged, inverted view of a housing of the electrical connector of FIG. 5.
Figure 7:
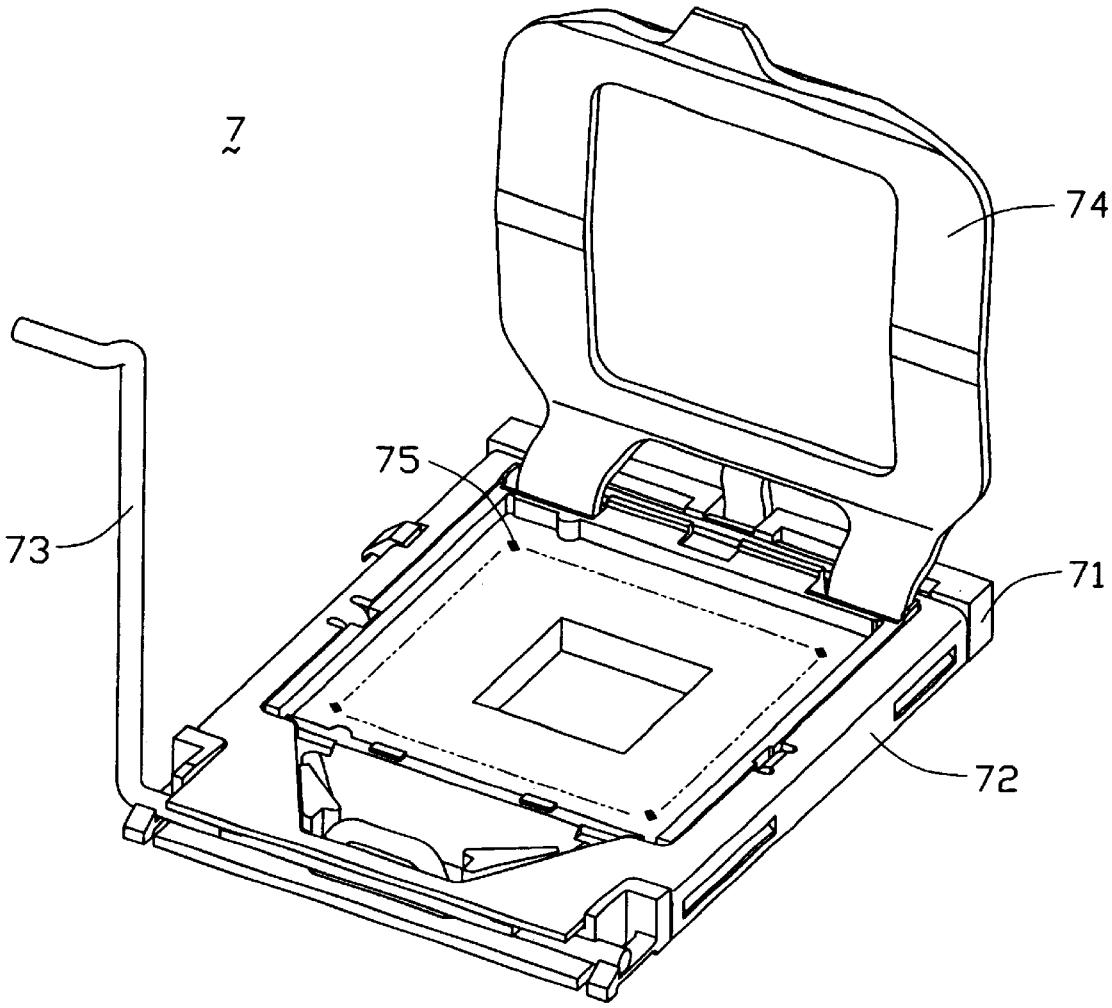
FIG. 7 (PRIOR ART)
FIG. 7 is an isometric assembled view of FIG. 5.

Referring to FIG. 4, in assembly, the pressing portion 522 of the load lever 5 is received in the receiving recess 220 of the housing 2, and the pivot axles 521 of the load lever 5 are pivotably received in the receiving groove 221 of the housing 2. The latch portions 240 of the housing 2 are fastened in the corresponding latch slots 320 of the stiffener 3. The locating latches 322 of the stiffener 3 are received in the corresponding locating slots 243 of the housing 2. The second plates 34 of the stiffener 3 are received in the corresponding locating recesses 232 of the housing 2. This ensures sturdy and reliable attachment of the stiffener 3 to the housing 2. The pivot latches 40 of the load plate 4 are received in the corresponding pivot slots 230 of the housing 2, thereby pivotably mounting the load plate 4 to the housing 2.

Because the flexibility of each latch portion 240 of the housing 2 is enhanced as detailed above, the latch portions 240 are easily received in the corresponding latch slots 320 of the stiffener 3. Thus, the stiffener 3 is readily attached to the housing 2, and the housing 2 is protected from damage during assembly.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting an electronic package with a circuit substrate, the electrical connector comprising:

an insulative housing comprising two opposite sidewalls, a first end portion and a second end portion, each sidewall comprising at least one latch portion;

a plurality of terminals received in the housing;

a metal stiffener mounted on the housing, and comprising a planar portion and a pair of elongated first plates extending perpendicularly from the planar portion, each first plate comprising at least one latch slot for engaging with the at least one latch portion of the housing;

a load lever attached to the first end portion of the housing; and a load plate pivotally mounted to the second end portion of the housing;

wherein at least one channel is defined in each of the sidewalls of the housing at respective latch portion thereby forming at least one resilient arm, whereby, flexibility of the latch portions of the housing is enhanced thereby facilitating easy engagement of the stiffener onto the housing.

2. The electrical connector as claimed in claim 1, wherein each of the sidewalls of the housing comprises a pair of latch portions, and defines a pair of C-shaped channels in a bottom thereof at respective latch portions.

3. The electrical connector as claimed in claim 1, wherein the first end portion comprises an elongated receiving groove, and a generally trapezoidal receiving recess in communication with the receiving groove.

4. The electrical connector as claimed in claim 3, wherein the load lever comprises a pivot portion having a pair of pivot axles received in the receiving groove of the housing, and a pressing portion received in the receiving recess of the housing.

5. The electrical connector as claimed in claim 1, wherein the second end portion comprises a pivot slot and a locating recess.

6. The electrical connector as claimed in claim 5, wherein the load plate comprises a pair of pivot latches received in the pivot slot of the housing, and a hook portion pressed by the pressing portion of the stiffener when the load plate engages with the housing.

7. An electrical connector comprising:

a rectangular insulative housing defining two opposite side walls between two opposite ends in a front-to-back direction, each of said side walls defining a latching protrusion on an exterior face thereon and extending along said front-to-back direction;

a plurality of terminals received in a middle portion of the housing; and a stiffener mounting on the housing, said stiffener including a planar portion seated upon the housing and a pair of plates downwardly extending from two sides of said planar portion along said front-to-back direction, and abutting against the exterior faces of the side walls, respectively, each of said plates defining a latch recess receiving the corresponding latching protrusion therein; wherein a U-shaped channel formed in the housing around the latching protrusion to form a resilient arm on which said latching protrusion is located.

8. The connector as claimed in claim 7, wherein said channel fully communicates with an exterior via a bottom face of the housing.

* * * * *